United States Patent [19]

Loeb et al.

[11] Patent Number: 4,662,460

[45] Date of Patent: May 5, 1987

[54] ROTARY DRILLING JAR

[75] Inventors: James B. Loeb, Dallas; Andrew J. Osborne, Jr., Ovilla; Raul A. Miglierini, Mesquite, all of Tex.

[73] Assignee: Dresser Industries, Inc., Dallas, Tex.

[21] Appl. No.: 795,002

[22] Filed: Nov. 4, 1985

[51] Int. Cl.[4] ..... F21B 4/06

[52] U.S. Cl. ..... 175/305; 175/300; 166/178

[58] Field of Search ..... 175/294, 299–306; 166/178

[56] References Cited

U.S. PATENT DOCUMENTS 2,733,046 1/1956 Thompson ..... 175/303

4,333,542 6/1982 Taylor ..... 175/302 X

*Primary Examiner*—Stephen J. Novosad

*Assistant Examiner*—Thuy M. Bui

[57] ABSTRACT

The rotary drilling jar includes inner and outer mandrels releaseably locked against relative longitudinal movement. The inner mandrel is connected to the drilling string and the outer mandrel is connected to the drill bit or other well tools suspended below the jar in the well bore. A detent mechanism releaseably connects the inner and outer mandrels and includes a stack of Belleville springs that is configured to determined the amount of force required to move the detent mechanism to unlock the mandrels to permit relative longitudinal movement. In one aspect, the jar also includes an upwardly facing shoulder on the inner mandrel and outwardly facing shoulder on the outer mandrel that are in engagement when the jar is being lowered into, suspended in, and pulled from the well bore to prevent the imposition of string weight on the detent mechanism.

25 Claims, 11 Drawing Figures

ROTARY DRILLING JAR

BACKGROUND OF THE INVENTION

This invention relates generally to jars that are used in freeing tools which become stuck in the well bore. More particularly, but not by way of limitation, this invention relates to an improved rotary jar for use in freeing well tools and the like that become stuck while drilling a well bore.

Rotary drilling jars are illustrated in U.S. Pat. No. 1,801,673 issued to G. S. Knox on Apr. 21, 1931, in U.S. Pat. No. 3,834,471 issued Sept. 10, 1974 to Clifford C. Bottoms, and in U.S. Pat. No. 4,511,007 issued Apr. 16, 1985 to Thomas Jung et al. Each of these patents illustrates a different arrangement of a jar that includes a different structural arrangement for locking the relatively moving parts of the jars together until a predetermined tension or compression force is applied thereto. When the predetermined force is exceeded, the relatively moving parts are released, permitting shoulders thereon to come into engagement, causing an impact or jarring action to be transmitted into the drill string in which the jar is located and into any well tool which may be stuck in the well.

An object of this invention is to provide an improved jar for use in a drilling string which reduces wear on component parts, reduces maintenance, increases the rapidity with which the lock releases the relatively moving parts of the jar, and which transmits rotary torque therethrough from the drill string to the drill bit in either direction.

Another object of the invention is to provide an improved jar having the above advantages, and in addition, prevents the application of the drilling string weight to the jar locking mechanism when the drilling string is being lowered into or removed from the well bore.

SUMMARY OF THE INVENTION

Accordingly, this invention then provides an improved jar for use in freeing well tools and the like stuck in a well bore, the improvement comprises: a tubular inner mandrel having a downwardly facing shoulder thereon and having an annular groove in an exterior surface thereof located relatively below the shoulder, the inner mandrel being arranged for connection to a conduit when positioned in the well bore; a tubular outer mandrel encircling the inner mandrel and arranged at a lower end for connection to the well tool and having an upwardly facing abutment in engagement with the downwardly facing shoulder and having an elongated annular recess located in the interior thereof below the abutment; and, a detent located in the annular recess for releaseably locking the inner and outer mandrels together. The detent includes a plurality of movable detent members engageable with the inner mandrel in the annular groove and including detent support members located in the annular recess in engagement with the detent members for determining a preselected release force for unlocking the mandrels permitting the downwardly facing shoulder on the inner mandrel to impact the upwardly facing abutment on the outer mandrel to impart a jarring action to the stuck well tools.

Also, the invention contemplates the above jar and also includes an upwardly facing shoulder on the inner mandrel that is engagement with a downwardly facing shoulder on the outer mandrel to support the outer mandrel and tools therebelow when the jar is suspended in or being moved through the well bore during normal drilling operations.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
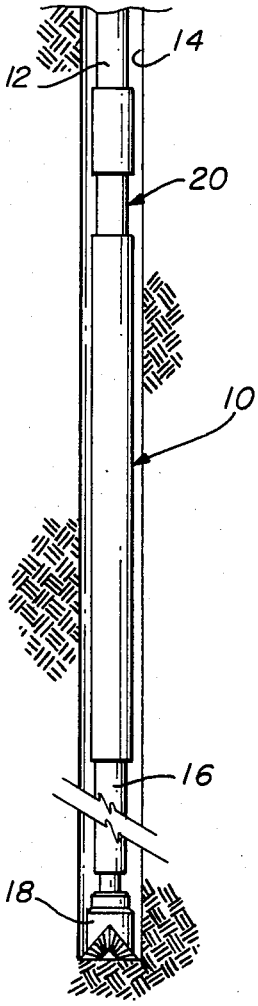
FIG. 1 is an elevation view of a jar constructed in accordance with the invention located in a well bore.

Referring to the drawing, and to FIG. 1 in particular, shown therein and generally indicated by the reference character 10, is a drilling jar that is constructed in accordance with the invention. The upper end of the drilling jar is connected to drill pipe 12 that extends into a well bore 14. At its lower end, the jar 10 is connected to a series of drill collars 16 which are in turn connected at their lower end to a drill bit 18. The conduit or drill pipe 12 will, of course, extend to the surface where the entire drilling string will be manipulated to perform the desired drilling operation.

Figure 2:
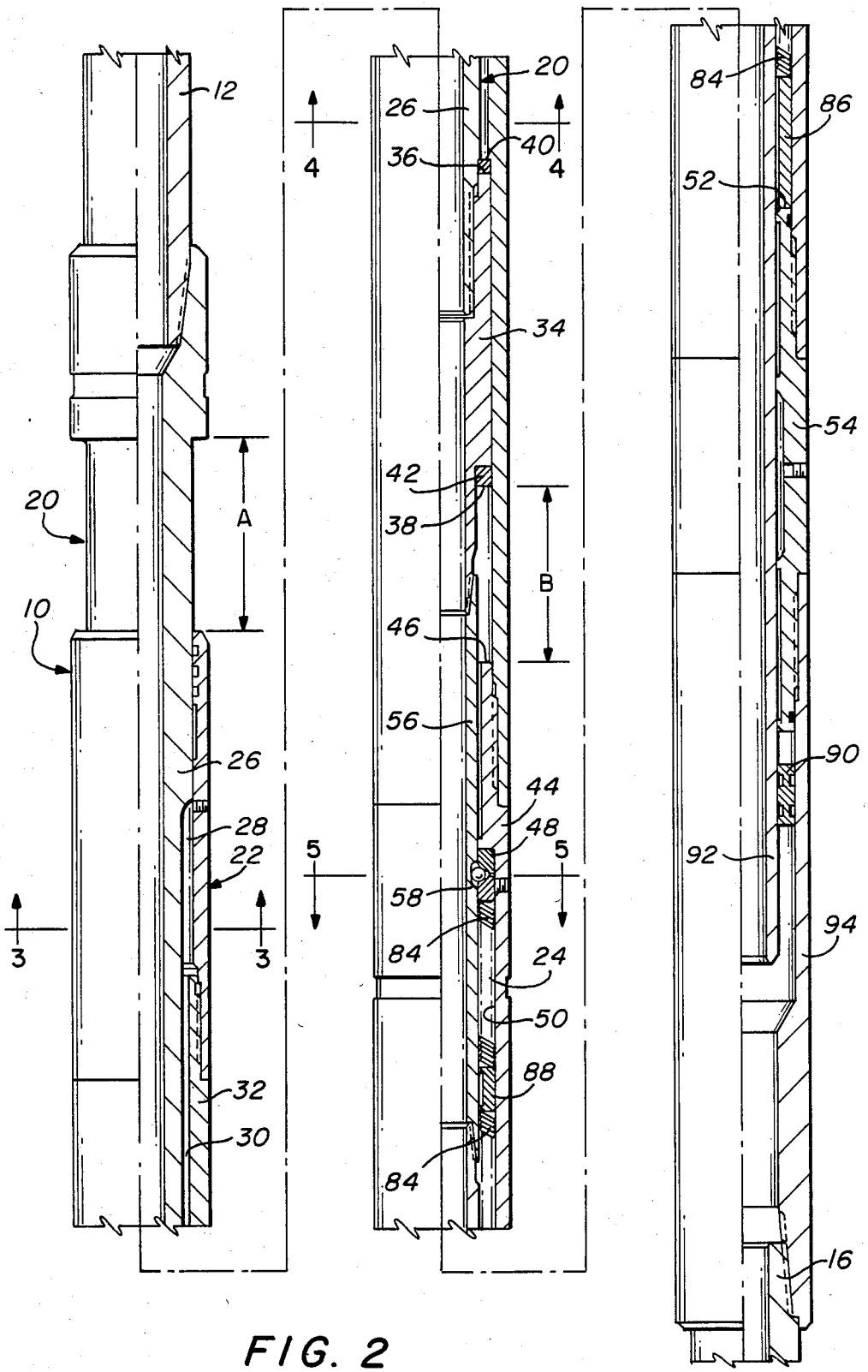
FIG. 2 comprises an enlarged, longitudinal cross section of one embodiment of jar that is constructed in accordance with the invention.

FIG. 2 illustrates a greatly enlarged longitudinal cross-sectional view of the jar 10. The jar 10 includes an inner mandrel assembly 20 that extends almost entirely therethrough. An outer mandrel assembly 22 generally encircles the exterior of the inner mandrel assembly 20, and a detent or locking assembly 24 releaseably locks the inner and outer mandrel assemblies together against relative longitudinal movement.

As illustrated, the upper end of the inner mandrel assembly 20 is threadedly connected to the conduit or drill pipe 12. The lower end of the outer mandrel assembly 22 is threadedly connected to a drill collar 16 or to other desirable well tools located therebelow.

Figure 3:
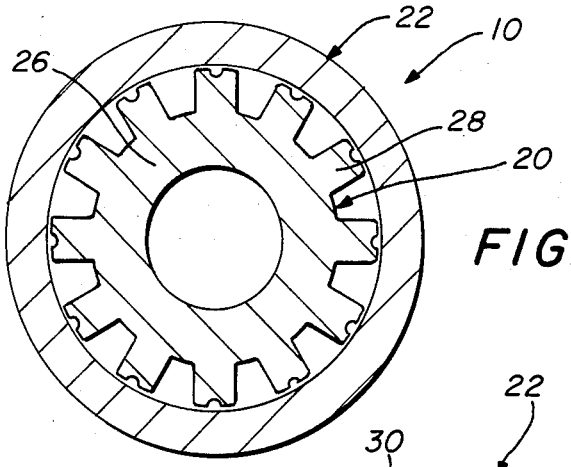
FIG. 3 is a transverse cross-sectional view taken generally along the line 3—3 of FIG. 2.
Figure 4:
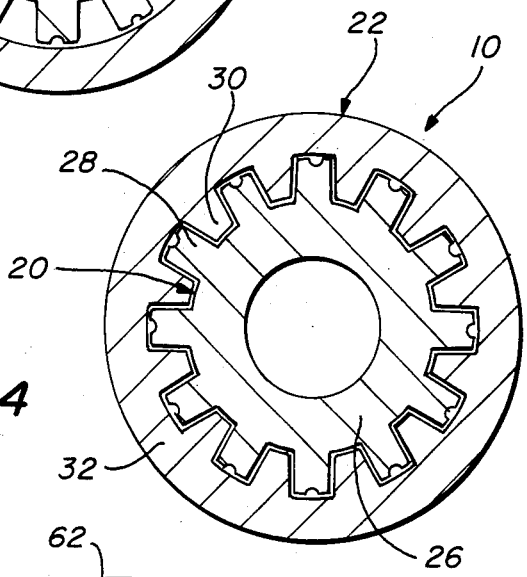
FIG. 4 is a transverse cross-sectional view taken generally along the line 4—4 of FIG. 2.
Figure 5:
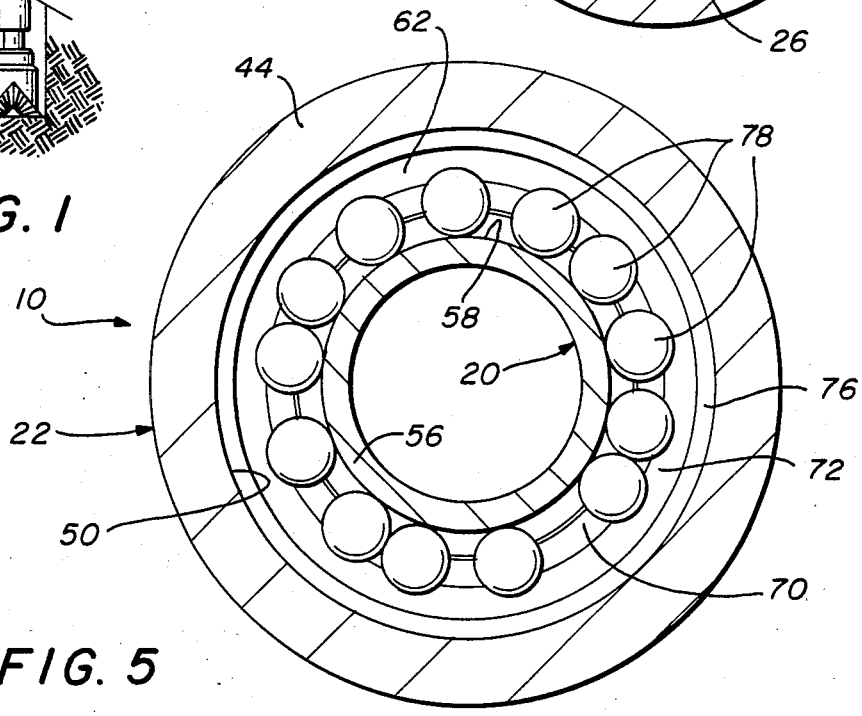
FIG. 5 is a transverse cross-sectional view taken along the line 5—5 of FIG. 2.

The inner mandrel assembly 20, for purposes of manufacturing, is constructed from a plurality of parts which are generally threaded together to form the unitary mandrel assembly 20. The mandrel assembly 20 includes a splined mandrel portion 26 that has a plurality of splines 28 projecting radially outwardly from the exterior thereof, as may be seen more clearly in FIG. 3. The splines 28 mate with a plurality of interior splines 30 that are formed in the interior of a spline tube 34 which forms a part of the outer mandrel assembly 22. The relationship between the splines 28 and 30 is clearly illustrated in FIG. 4.

The jar 10, as previously mentioned, is a drilling jar and as such, must be capable of transmitting torque or rotational movement from the drill pipe 12 to the bit 18. The splines 28 and 30 are utilized for transmitting rotational movement between the inner mandrel assembly 20 and the outer mandrel assembly 22 while permitting relative longitudinal movement therebetween.

A flange tube 34 is threadedly attached to the lower end of the spline mandrel 26 and provides an upwardly facing flange or shoulder 36 and a downwardly facing flange or shoulder 38 for purposes that will be explained more fully hereinafter. Located between the inner mandrel assembly 20 and the outer mandrel assembly 22 is a percussion ring 40 which is in engagement with the upwardly facing shoulder 36 and is in engagement with the lower end of the splines 30 formed in the spline tube 32. The arrangement permits the weight of the outer mandrel assembly 22. and any tools connected thereto below the jar 10, to be carried by the inner mandrel assembly 20 through the shoulder 36 and the percussion ring 40.

A second percussion ring 42 is located just below the downwardly facing shoulder 38 and is provided to absorb the shock produced when the jar is utilized to free stuck tools. A detent tube 44 is connected to the lower end of the spline tube 32 and has an upwardly facing shoulder 46 formed thereon that will engage the second percussion ring 42 during the operation of the jar 10.

The detent tube 44 is also provided with a downwardly facing shoulder 48 which forms the upper end of an annular recess 50. The lower end of the recess 50 is determined by an upper end 52 on a compensator tube 54.

Figure 6:
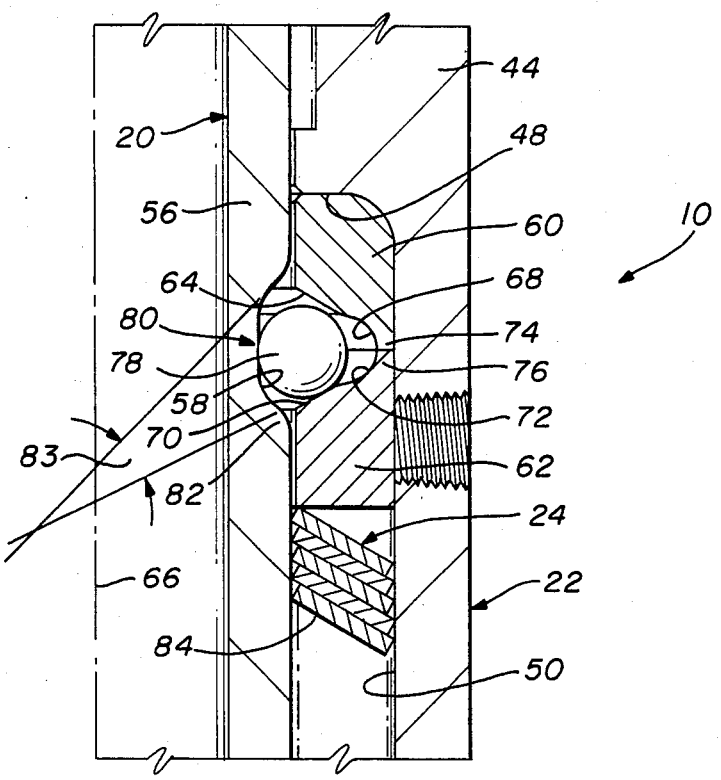
FIG. 6 is an enlarged, fragmentary cross-sectional view of detent apparatus utilized in the jar of FIG. 1 shown in the latched position.

A locking tube 56 forms part of the inner mandrel assembly 20 and is attached to the lower end of the flange tube 34. The locking tube 56 has an annular, elongated groove 58 formed in its exterior. As may be seen more clearly in FIG. 6, the detent assembly 24, which locks the inner mandrel assembly 20 to the outer mandrel assembly 22 includes upper and lower support rings 60 and 62 which are located in the recess 50. The upper support ring 60 is in abutting relationship to the downwardly facing shoulder 48 provided by the detent tube 44.

The upper support ring 60 includes a surface 64 that is disposed at an angle relative to a centerline 66 of the inner mandrel assembly 20. The support ring 60 also includes an annular surface 68 that intersects the surface 64 and that is disposed at an angle relative to the centerline 66 but at an angle different than the surface 64. The reasons for the different angular dispositions of the surfaces 64 and 68 will become more apparent hereinafter.

The lower support ring 62 also includes an annular surface 70 that is disposed at an angle relative to the centerline 66 and a second annular surface 72 which intersects the surface 70 and like the surface 68 is disposed at a different angle relative to the centerline 66 than the surface 70.

The surfaces 64 and 70 preferably are disposed at an angle of about 55° relative to the centerline 66 while the surfaces 68 and 72 preferably are disposed at an angle of about 75° relative to the centerline 66. The surfaces are spaced from each other by the engagement of an annular axial projection 74 on the upper support ring 60 with an annular axial projection 76 on the lower support ring 62. The surfaces 64 and 70 are spaced a sufficient distance apart so that a plurality of detent members or balls 78 can be located therebetween and in the annular groove 58 without touching both of the surfaces 64 and 70 and the bottom of groove 58 at the same time. The detent members 78 reposition and relubricate themselves due to vibration and movement of the jar 10 so that the detent members 78 present a new contact surface each time the tool is in operation. Such repositioning substantially reduces wear on the detent members 78.

The annular groove 58 located in the locking tube 56 is elongated in the axial direction so that it is substantially longer than the detent members 78. Such elongation permits the shoulder 36 on the inner mandrel assembly 20 to engage the percussion ring 40 to carry the weight of the outer mandrel assembly 22 and any tools located therebelow and thus avoid applying any of the tool weight to the detent assembly 24.

It will also be noted that the groove 58 has rather generous radii 80 at the bottom of the groove 58 and a rather generous radii 82 at the intersection between the tapered groove 58 and the exterior of the locking tube 56. Preferably, the radii 80 should not be less than the radii of the detent members 78 and the radii 82 are preferably at least twice the size of the radius of the detent members 78 to substantially reduce wear on the locking tube 56. The locking tube 56 is necessarily constructed from high quality, heat treatable steel to be able to sustain the constant abuse of locking and releasing the inner mandrel assembly 20 and the outer mandrel assembly 22. Each end of the tapered groove 58 and the opposite surface 64 or 70 on the support rings 60 and 62 form an acute angle 83. The angle 83 is referred to as the release angle and determines the force necessary to move the support member 62 with the detent members 78. If the surfaces are parallel, the detent will not release.

Located in the recess 50 below the lower support ring 62 is a plurality of annular Belleville springs 84. The lower end of the stack of springs 84 is in engagement with a spacer member 86 that has its lower end engaging the upper end 52 of the compensator tube 54. If desired, a floating stabilizer can be inserted in the stack of Belleville springs 84, further reducing the number of springs required. The force necessary to move the lower support ring 62 will be determined by the configuration of the Belleville springs 84 as well as the number of springs utilized and the geometry of the support rings 60 and 62. The spacer member 86 can be of any suitable length depending on the number of springs 84 utilized.

In the drawing, a compensator piston 90 is illustrated as being located between a wash pipe 92, which is attached to the end of the inner mandrel assembly 20, and a seal cylinder 94 connected to the lower end the compensator tube 54. The purpose of the compensator piston 90 is to balance the pressures inside and outside of the jar if the space between the mandrel assemblies is filled with a lubricant. Its use is optional.

If the compensator piston is not used, a seal (not shown) is usually attached to the wash pipe 92. The seal prevents drilling fluid from entering the space between the wash pipe 92 and the seal cylinder 94. The lower end of the seal cylinder 94 is connected to the drill collar 16 or to other desirable tools in the well below the jar as previously pointed out.

OPERATION

With the jar 10 extended into the well bore 14 as illustrated in FIG. 1, and assuming that the bit 18 or other tool thereinbelow has become stuck while attempting to remove the overall apparatus from the well bore 14, it is desirable to be able to exert a downwardly directed force, such as a jarring action, on the tool in an effort to dislodge it from its stuck position.

Figure 7:
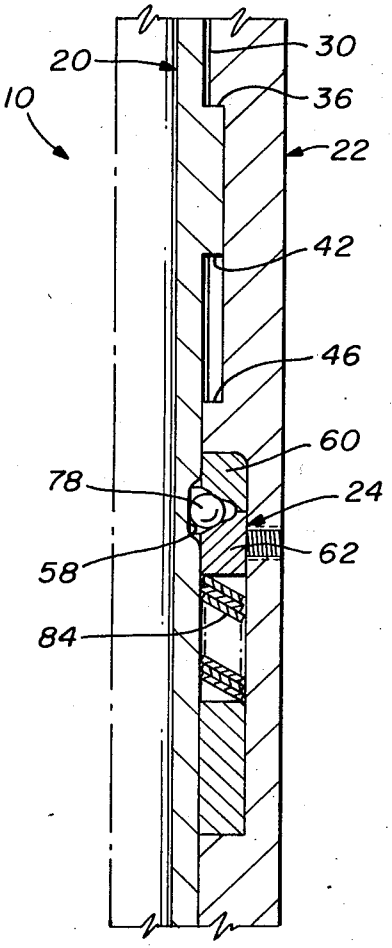
FIG. 7 is a schematic cross-sectional view of the jar of FIG. 1 with the various components illustrated in the positions they occupy when the jar is extended into the well bore.

As previously mentioned, the weight of the tools below the jar 10 are carried by the inner mandrel assembly 20 through the shoulder 36 engaging the lower end of the splines 30 on the outer mandrel 22. As shown in FIG. 7, the downwardly facing shoulder 42 on the inner mandrel assembly 20 is located in a spaced relationship to the upwardly facing shoulder 46 on the outer mandrel assembly 22. The shoulders are releaseably held in this relationship by the detent assembly 24. The detent members 78 are disposed in the annular groove 58 in the inner mandrel assembly 20 and in engagement with the support rings 60 and 62 in the outer mandrel assembly 22.

When it is desired to jar the stuck tools, weight is set down on the drill string 12, which imposes a force on the inner mandrel assembly 20, moving the inner mandrel assembly 20 relatively downwardly with respect to the outer mandrel assembly 22. When the angular surface of the annular groove 58 engages the detent members 78, they are forced radially outwardly exerting an axial downward force on the lower support ring 62 against the force exerted by the Belleville springs 84. When sufficient force is exerted to overcome the preselected force exerted by the springs 84, the lower support ring 62 begins to move downwardly with the detent members 78 in engagement with the surface 70 thereon. When the members 78 reach the intersection between the surface 70 and the surface 72 on the lower support ring 62, the detent members 78 engage the greater angular surface and move rapidly into the position illustrated in FIG. 9.

Figure 9:
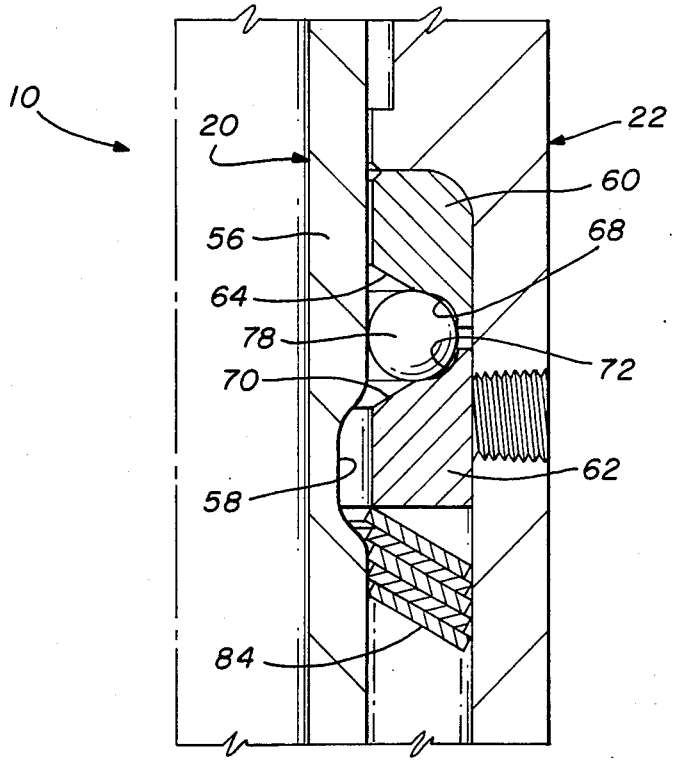
FIG. 9 is a view similar to FIG. 6, but showing the detent in the unlocked position.
Figure 8:
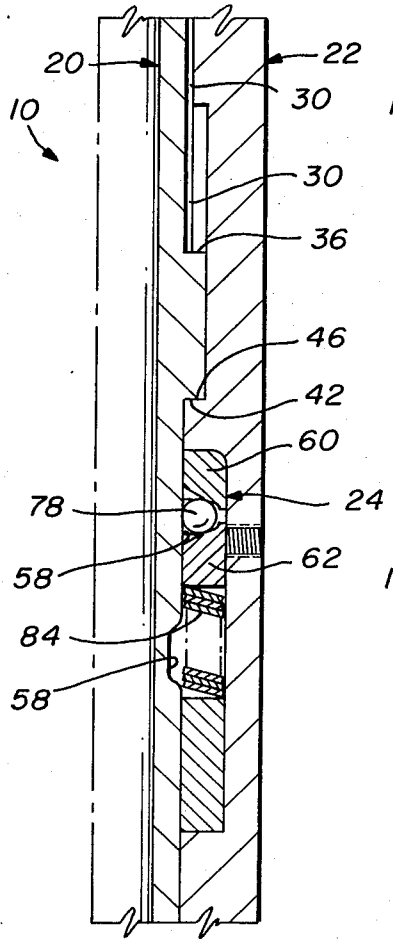
FIG. 8 is a cross-sectional view similar to FIG. 7 but illustrating the various parts of the jar in the positions they occupy when the detent has been released.

It can be seen in FIG. 9 that the inner mandrel assembly 20 has been released from its locking relationship with the outer mandrel assembly 22. The weight exerted on the inner mandrel assembly 20 by the drill string 12 is then exerted to move the shoulder 42 rapidly into engagement with the upwardly facing shoulder 46 on the outer mandrel assembly 42 (see FIG. 8) imposing the impact force on the outer mandrel assembly 22 and to any tools connected therebelow.

If more than one jar or impact is necessary to release the stuck tools, the drill string 12 is picked up and the inner mandrel assembly 20 moves upwardly relative to the outer mandrel assembly 22 until the upwardly facing shoulder 36 on the inner mandrel assembly 20 engages the lower end of the splines 30 on the outer mandrel assembly 22, placing the annular groove 58 adjacent to the detent members 78. When this occurs, detent members 78 under the influence of springs 84 and the lower support ring 62, move inwardly into the groove 58 releaseably locking the inner and outer mandrel assemblies. To impart the jarring action to the stuck tools again, the procedure as outlined above is repeated.

Thus, the jar 10 is capable of providing a down jarring action to the stuck tools rapidly and repeatedly and is arranged to reduce wear on areas of the jar which are subjected to repeated and rather violent action as the jarring action takes place.

THE MODIFICATION OF FIGS. 10 AND 11

Figure 11:
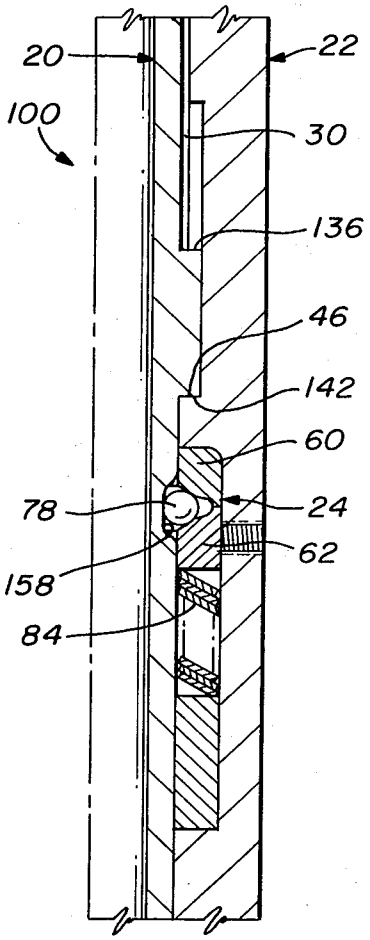
FIG. 11 is a view similar to FIG. 10, but illustrating the parts of the up jar of FIG. 10 and the positions they occupy after the detent has been positioned to lock the components together.
Figure 10:
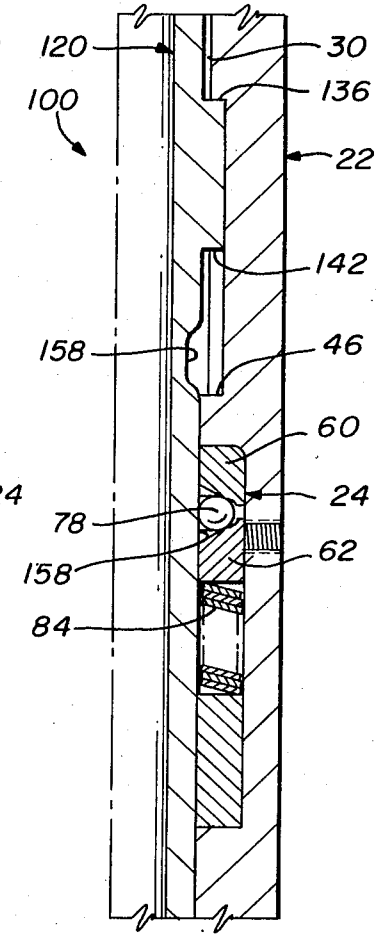
FIG. 10 is a schematic, cross-sectional view similar to FIG. 7, but illustrating the position of the various parts of the jar when it is to be extended into the well bore and to be utilized as an up jar.

FIGS. 10 and 11 illustrate schematically a modification of the jar 10 which is designated generally by the reference character 100. The modification has been made to permit the jar 10 to be utilized as an up jar. Those components of the jar 100 which are identical to those previously described will be indicated by the same reference characters.

The jar 100 includes an inner mandrel assembly 120 that is essentially the same as the mandrel assembly 20. The annular groove which is designated in the jar 100 by the reference character 158 is located in a different place. The annular groove 158 is identical in configuration to the groove 58 previously described, but is located relative to an upwardly facing shoulder 136 so that when the shoulder 136 is in engagement with the lower end of the splines 30 on the outer mandrel assembly 22, the annular groove 158 will be located above the detent assembly 24. Thus, when the jar 100 is lowered into the well bore, the weight is supported on the shoulder 136 which engages the outer mandrel 22, but the inner mandrel assembly 120 and the outer mandrel assembly 22 are not locked against relative longitudinal movement except by the aforementioned shoulders.

In the position illustrated in FIG. 10, it can be seen that a downwardly facing shoulder 142 on the inner mandrel assembly 120 is located in spaced relation to the upwardly facing shoulder 46 of the outer mandrel assembly 22. Also, it will be noted that the detent members 78 are in the displaced position or unlocked, that is, with the spring 84 compressed and the lower support ring 62 moved downwardly.

Should it become necessary to exert an upward jarring action to the drill string, the weight of the drill string 12 will be set down on the inner mandrel 120 moving the groove 158 downwardly to the position illustrated in FIG. 11. When the groove 158 is disposed adjacent to the detent assembly 24, the detent members 78 move into the groove 158 under the influence of the lower support ring 62 and the Belleville springs 84, locking the inner and outer mandrel assemblies together.

To jar the stuck tools, an upward strain is taken on the drill string 12, storing a substantial amount of energy therein. When the lower tapered surface of the groove 158 engages the detent members 78 and sufficient force exerted therein to overcome the force of the spring 84, the detent members 84 move outwardly as previously described in connection with the description of the down jar 10, quickly releasing the inner mandrel assembly 120 from the outer mandrel assembly 22. When this occurs, the energy stored in the drill string 12 pulls the inner mandrel 120 upwardly, bringing the shoulder 136 thereon into sharp engagement with the lower end of the splines 30 and thereby imparting the desired upward jarring action.

To impart additional up jarring action, the drill string 12 is again set down on the inner mandrel assembly 120, placing the annular groove 158 adjacent to the detent assembly 124, recocking the jar and placing it in condition for exerting the upward force again. Thus, it will be appreciated that by simply replacing the locking tube 56, it is possible to convert the jar from a down jar to an up jar, and vice versa. In either event, a very efficient jarring action can be obtained with the components designed to absorb the wear on less expensive components and to assure positive actuation each time that the jarring action is desired.

It is possible to construct the jars without carrying the string weight on the shoulder 36 and 136. However, to do so entails the use of a plurality of rows of the detent assemblies 24. Providing multiple detent assemblies requires very carefully controlled dimensions so that all of the detents will release simultaneously, and thus the jar will be substantially more expensive.

The jar described in detail herein before is presented by way of example only and many change and modifications can be made thereto without departing from the spirit or scope of the invention.

What is claimed is:

1. An improved jar for use in freeing well tools and the like stuck in a well bore, the improvement comprising:

tubular, inner mandrel means having a downwardly facing shoulder thereon and having an annular groove in an exterior surface thereof located relatively below said shoulder, said annular groove in said inner mandrel means tapering inwardly from an exterior surface of said inner mandrel means, said inner mandrel means being arranged for connection to a conduit when positioned in the well bore;

tubular, outer mandrel means encircling said inner mandrel means and arranged at a lower end for connection to the well to tool and having an upwardly facing abutment engageable with said downwardly facing shoulder and having an elonagted annular recess located in the interior thereof below said abutment;

detent means located in said annular recess for releasably locking said inner and outer mandrel means together, said detent means including a plurality of moveable detent members engageable with said inner mandrel means in said annular groove, detent support means located in said annular recess in engagement with said detent members for determining a preselected release force for unlocking said mandrel means permitting said downwardly facing shoulder on said inner mandrel means to impact said upwardly facing abutment on said outer mandrel means to impart a jarring action to the stuck well tools, the groove in said inner mandrel means being wider at said exterior surface whereby movement of said inner mandrel means relative to said outer mandrel means urges said detent members out of said groove to unlock said mandrel means; and said detent means also including resilient means located in said annular recess exerting a force on said support means to prevent movement of said detent members out of said annular groove releasably locking said inner and outer mandrel means against movement relative to each other until said release force is exceeded.

2. An improved jar for use in freeing well tools and the like stuck in a well bore, the improvement comprising:

tubular, inner mandrel means having an upwardly facing shoulder thereon, having a downwardly facing shoulder thereon below said upwardly facing shoulder, and having an annular groove in an exterior surface thereof located relatively below said shoulders, said annular groove in said inner mandrel means tapering inwardly from an exterior surface of said inner mandrel means, said inner mandrel means being arranged for connection to a conduit when positined in the well bore;

tubular, outer mandrel means encircling said inner mandrel means and arranged at a lower end for connection to the well tool and having an upwardly facing abutment engageable with said downwardly facing shoulder, having a downwardly facing upper abutment and having an elongated annular recess located in the interior thereof below said abutment, said upwardly facing shoulder engaging said downwardly facing upper abutment to support said outer mandrel means when the jar is suspended in the well bore on the conduit; and, detent means located in said annular recess for releasably locking said inner and outer mandrel means together, said detent means including a plurality of moveable detent means engageable with said inner mandrel means in said annular groove, and including detent support means located in said annular recess in engagement with said detent members for determining a preselected release force for unlocking said mandrel means permitting said downwardly facing shoulder on said inner mandrel means to impact said upwardly facing abutment on said outer mandrel means to impart a jarring action to the stuck well tools, the groove being wider at said exterior surface whereby movement of said inner mandrel means relative to said outer mandrel urges said detent members out of said groove to unlock said mandrel means; and said detent means also includes resilient means located in said annular recess exerting a force on said support means to prevent movement of said detent members out of said annular groove releasably locking said inner and outer mandrel means against movement relative to each other until said release force is exceeded.

3. In an improved down jar for use in freeing a well tool stuck in a well bore, the jar including an inner mandrel connected to a drilling string extending into a well bore and an outer mandrel connected to the well tool, said inner mandrel having a downwardly facing impact shoulder thereon and the outer mandrel having an upwardly facing impact abutment thereon arranged to come in sharp engagement to impart a jarring action to the tool upon release of detent means releasably locking the inner and outer mandrels together, the improvement comprising:

an upwardly facing support shoulder on said inner mandrel; and a downwardly facing support abutment on said outer mandrel engaging said upwardly facing support shoulder to support said outer mandrel and well tool when the jar is suspended in the well bore, whereby said detent means is loaded only when said inner mandrel is moved downwardly respect to said outer mandrel to jar the stuck tool.

4. The jar of claim 1 wherein said detent support means includes:

an annular first support member having an annular surface engaging said detent members and angularly disposed relative to a centerline of said mandrel means; and, an annular second support member in engagement with said resilient means and having an annular surface engaging said detent.

5. The jar of claim 4 wherein said surfaces on said support members are disposed at an acute angle relative to an angle defined by said tapered groove.

6. The jar of claim 5 wherein said support members each include a second annular surface disposed at an angle relative to each said first mentioned surface and at a more acute angle relative to said cenerline whereby said detent members initially move radially slowly out of said groove and then move radially quickly to unlock said mandrel means.

7. The jar of claim 6 wherein said detent members are spheres.

8. The jar of claim 7 wherein said groove includes end portions having a radius greater than the radius of said spheres.

9. The jar of claim 8 wherein said groove has an axial length greater than the diameter of said spheres.

10. The jar of claim 9 wherein said first mentioned surfaces are separated by an axial distance greater than the diameter of a corresponding spherical segment of one of said spheres when disposed in engagement with said inner mandrel means in said groove, said spheres are moveable in said groove to randomly change the contact of said spheres with said inner mandrel means and with said detent support means.

11. The jar of claim 10 wherein:

said resilient means includes a plurality of Belleville springs located in said annular recess in engagement with said support means; and, said detent means also includes an elongate, annular spacer member located in said annular recess whereby the preselected release force is determined by the length of said spacer member and the number of said springs.

12. The jar of claim 11 wherein:

said inner mandrel means also has an upwardly facing shoulder thereon above said downwardly facing shoulder; and, said outer mandrel means also has a downwardly facing upper abutment engaging said upwardly facing shoulder to support said outer mandrel means when the jar is suspended in the well bore on the conduit.

13. An improved jar for use in freeing well tools and the like stuck in a well bore, the improvement comprising:

tubular, inner mandrel means having an upwardly facing shoulder thereon, having a downwardly facing shoulder thereon below said upwardly facing shoulder, and having an annular groove in an exterior surface thereof located relatively below said shoulders, said inner mandrel means being arranged for connection to a conduit when positioned in the well bore;

tubular, outer mandrel means encircling said inner mandrel means and arranged at a lower end for connection to the well tool and having an upwardly facing abutment engageable with said downwardly facing shoulder, having a downwardly facing upper abutment, and having an elongated annular recess located in the interior thereof below said abutment, said upwardly facing shoulder engaging said downwardly facing upper abutment to support said outer mandrel means when the jar is suspended in the well bore on the conduit; and, detent means located in said annular recess for releaseably locking said inner and outer mandrel means together, said detent means including a plurality of moveable detent members engageable with said inner mandrel means in said annular groove, and including detent support means located in said annular recess in engagement with said detent members for determining a preselected release force for unlocking said mandrel means permitting said downwardly facing shoulder on said inner mandrel means to impact said upwardly facing abutment on said outer mandrel means to impart a jarring action to the stuck well tools.

14. The jar of claim 13 wherein the annular groove in said inner mandrel means tapers inwardly from an exterior surface of said inner mandrel means, said groove being wider at said exterior surface whereby movement of said inner mandrel means relative to said outer mandrel means urges said detent members out of said groove to unlock said mandrel means.

15. The jar of claim 14 wherein said detent means also includes resilient means located in said annular recess exerting a force on said support means to prevent movement of said detent members out of said annular groove releaseably locking said inner and outer mandrel means against movement relative to each other until said release force is exceeded.

16. The jar of claim 27 wherein said detent support means includes:

an annular first support member having an annular surface engaging said detent members and angularly disposed relative to a centerline of said mandrel means; and, an annular second support member in engagement with said resilient means and having an annular surface engaging said detent.

17. The jar of claim 16 wherein said surfaces on said support members are disposed at an acute angle relative to an angle defined by said tapered groove.

18. The jar of claim 17 wherein said support members each include a second annular surface disposed at an angle relative to each said first mentioned surface and at a more acute angle relative to said cenerline whereby said detent members initially move radially slowly out of said groove and then move radially quickly to unlock said mandrel means.

19. The jar of claim 18 wherein said detent members are spheres.

20. The jar of claim 19 wherein said groove includes end portions having a radius greater than the radius of said spheres.

21. The jar of claim 20 wherein said groove has an axial length greater than the diameter of said spheres.

22. The jar of claim 21 wherein said first mentioned surfaces are separated by an axial distance greater than the diameter of a corresponding spherical segment of one of said spheres when disposed in engagement with said inner mandrel means in said groove, said spheres are moveable in said groove to randomly change the contact of said spheres with said inner mandrel means and with said detent support means.

23. The jar of claim 22 wherein:

said resilient means includes a plurality of Belleville springs located in said annular recess in engagement with said support means; and, said detent means also includes an elongate, annular spacer member located in said annular recess whereby the preselected release force is determined by the length of said spacer member and the number of said springs.

24. The jar of claim 12 wherein said inner and outer mandrel means include interconnecting means for locking said mandrel means together for rotational movement while permitting relative longitudinal movement therebetween.

25. The jar of claim 23 wherein said inner and outer mandrel means include interconnecting means for locking said mandrel means together for rotational movement while permitting relative longitudinal movement therebetween.

* * * * *